US005299996A

United States Patent [19]

Chi

[11] Patent Number: 5,299,996

[45] Date of Patent: Apr. 5, 1994

[54] SKIING SIMULATOR

[76] Inventor: Wu H. Chi, No. 1-2, Lane 975, Chun-Jih Road, Tao-Yuan City, Taiwan

[21] Appl. No.: 2,022

[22] Filed: Jan. 8, 1993

[51] Int. Cl.[5] ..... A63B 21/00

[52] U.S. Cl. ..... 482/70; 482/51; 482/52; 482/54; 482/71

[58] Field of Search ..... 482/51, 52, 70, 71, 482/72, 54, 1, 4, 5–9, 900, 901, 903; 434/253, 255

[56] References Cited

U.S. PATENT DOCUMENTS 4,618,139 10/1986 Haaheim ..... 482/71

4,900,013 2/1990 Rodgers ..... 482/71

*Primary Examiner*—Richard J. Apley

*Assistant Examiner*—Glenn E. Richman

*Attorney, Agent, or Firm*—Morton J. Rosenberg; David I. Klein

[57] ABSTRACT

A skiing simulator is provided which includes a load adjusting mechanism controlled by a control console for adjusting the resistance exerted by the load adjusting mechanism on a belt drive system disposed about a pair of guide tracks. A pair of foot pedals slidably mounted on the guide tracks, and a tension adjusting mechanism for adjusting the slack in the belt drive system is further provided. The control console is positioned on the skiing simulator to allow the user to change the resistance of the load adjusting mechanism without interrupting an exercise routine being performed.

1 Claim, 7 Drawing Sheets

SKIING SIMULATOR

BACKGROUND OF THE INVENTION

1. Field of the Invention

This invention relates to a skiing simulator. In particular, this invention pertains to a skiing simulator having a load adjusting mechanism which increases or decreases the resistance exerted on a belt mechanism of the ski simulator. The load adjusting mechanism is controlled by a computer control console positioned on the skiing simulator to allow the user to change the resistance of the load adjusting mechanism without interrupting any exercise routine being performed.

2. Prior Art

Skiing simulator devices are known in the art and have been widely accepted and used in Europe and North America since they provide the benefits of skiing in an indoor setting. Skiing simulators are known which include a user adjustable load device to allow the user to set a load (resistance) that is appropriate for his or her physical condition. In prior art skiing simulators, as shown in FIG. 7, the load device is adjusted by setting the tension of the braking wires by moving the braking disk b relative to another disk. The structure of such prior art skiing simulators prevents the user from setting and retaining a suitable resistance for an exercise routine. It has been found that changing the resistance on prior art skiing simulators is time consuming and cannot be accomplished without interrupting the user's exercise routine. Generally, the user changes the resistance during an exercise routine to simulate skiing downhill or uphill. As in actual skiing, when using the skiing simulator, both of the user's hands and legs are moving. In order to change the resistance of the prior art skiing simulator, the user must first stop the exercise routine, adjust the resistance to a desired level, and then restart the exercise routine, thereby interrupting the exercise routine and reducing the beneficial effects of the exercise routine.

SUMMARY OF THE INVENTION

In view of the previously described disadvantages of the prior art, the present invention concept provides a skiing simulator having a load adjusting mechanism which can be adjusted without interrupting the user's exercise routine.

It is an object of the present invention to mitigate and/or obviate the above-mentioned drawbacks of prior art skiing simulators in a manner set forth in the Description of the Preferred Embodiment.

A primary objective of the present invention is to provide a skiing simulator having a load adjusting mechanism which can be adjusted by the user through a control console without interruption of the user's exercise routine.

Another objective of the present invention is to provide a tension adjusting mechanism for adjusting the tension of the belt mechanism of the skiing simulator.

Further objectives and advantages of the present invention will become apparent as the following description proceeds, and features of novelty are characterized in the claims annexed to and forming a part of this invention.

DESCRIPTION OF THE PREFERRED EMBODIMENTS

Figure 1:
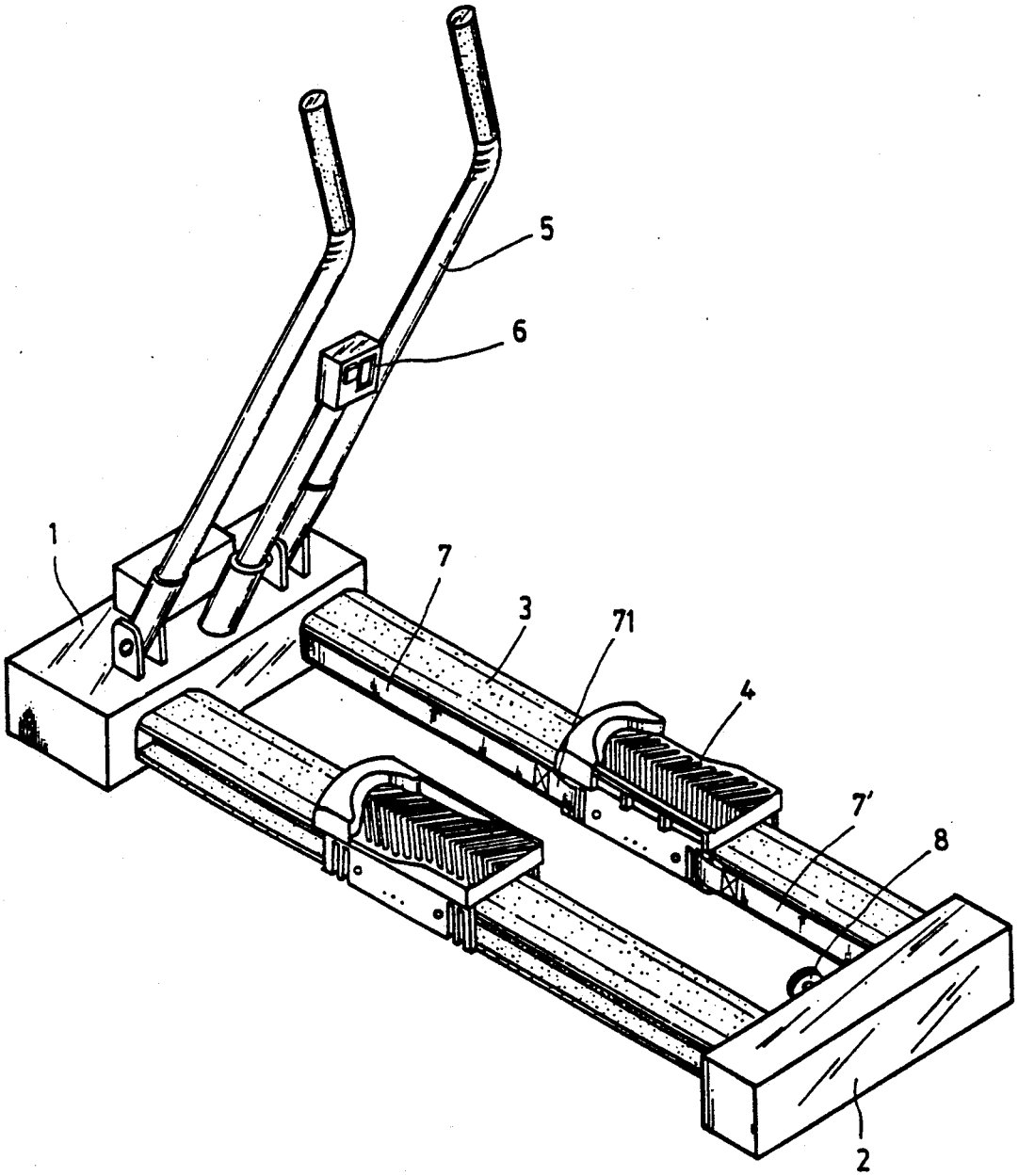
FIG. 1 is a perspective view of a skiing simulator in accordance with the present invention.
Figure 2:
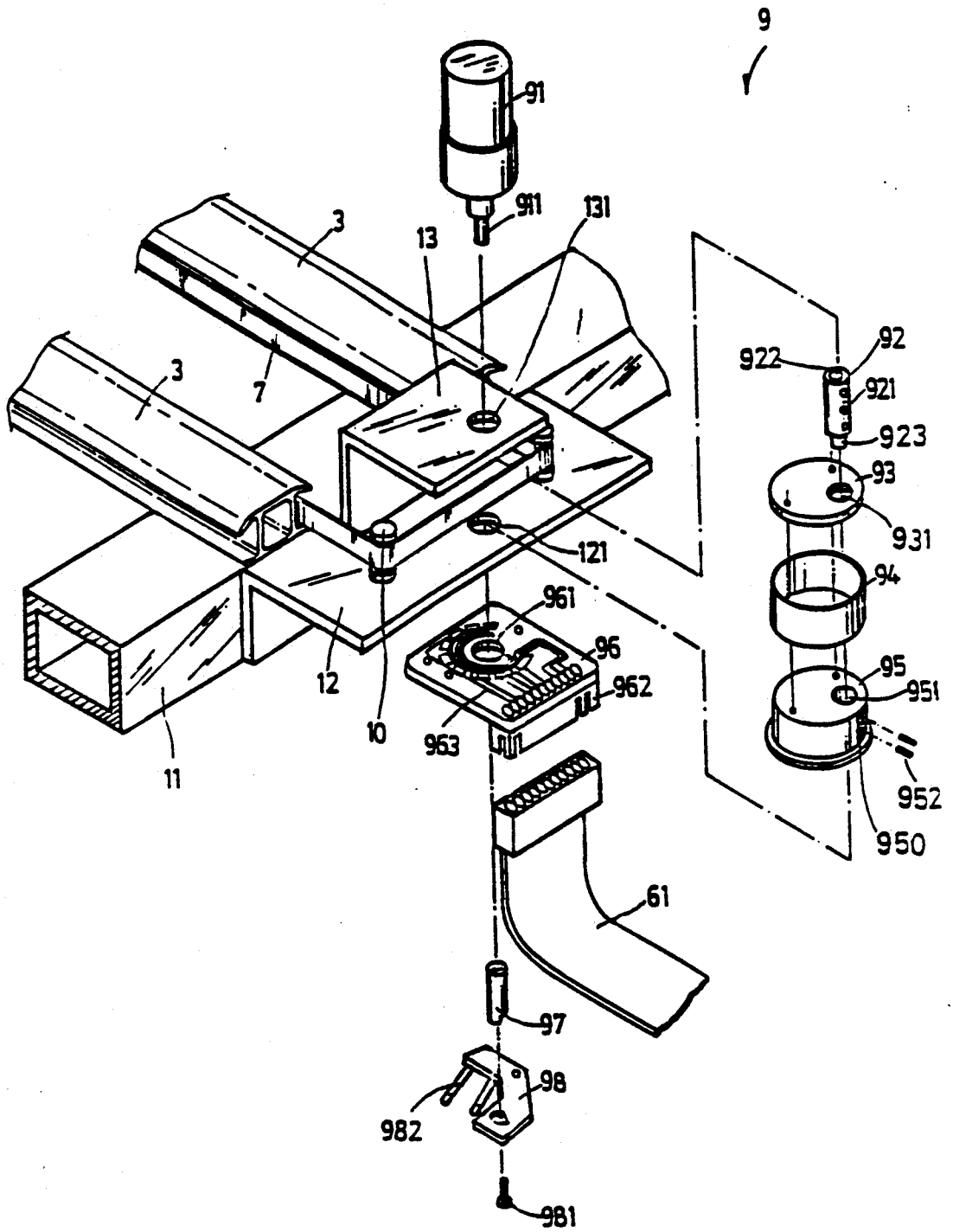
FIG. 2 is an exploded perspective view of the load adjusting mechanism of the skiing simulator in accordance with the present invention.
Figure 3:
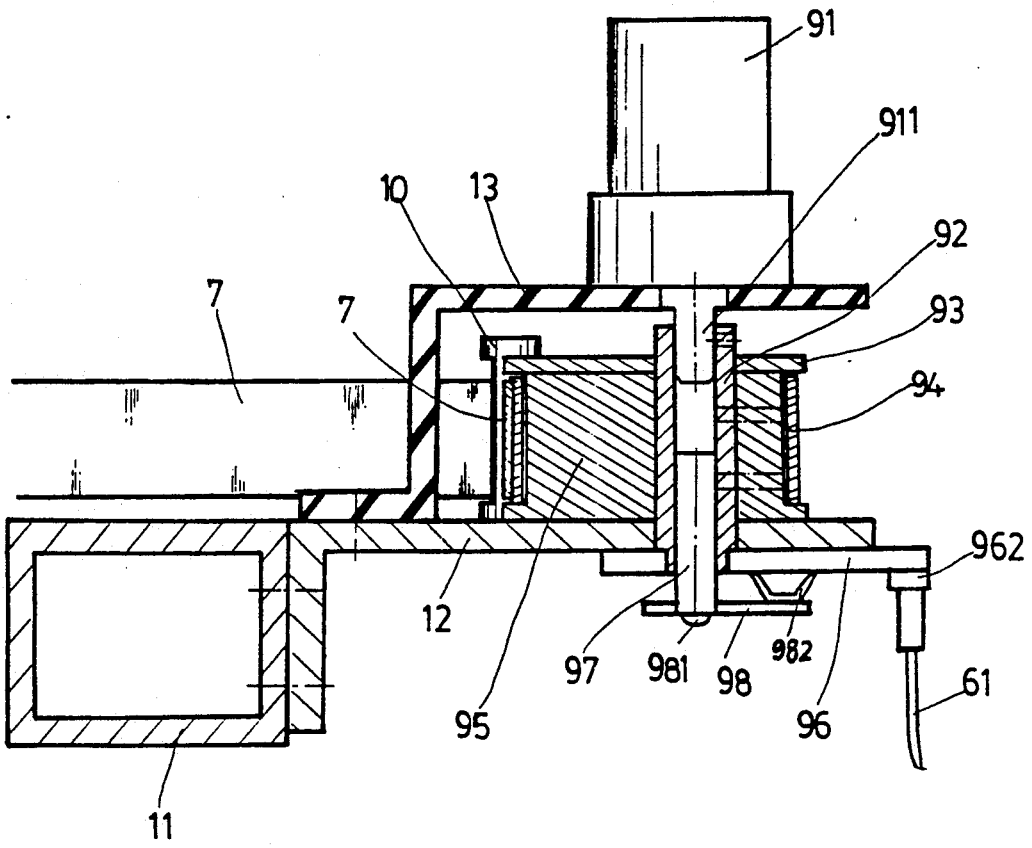
FIG. 3 is a cross-sectional view showing an assembled load adjusting mechanism in accordance with the present invention.

Referring now to FIGS. 1–3, there is shown a skiing simulator of the present invention comprising front and rear housings 1 and 2, respectively, an adjustable load device 9 mounted in the front housing 1. A pair of spaced parallel guide tracks 3 are disposed between the front and rear housings 1 and 2 with foot pedals 4 slidably mounted on each guide track 3. A belt-drive mechanism comprising front- and rear-end belts, 7 and 7', respectively, are disposed about the guide tracks 3 and interconnected with each foot pedal 4 for slidably moving the foot pedals 4 along the guide tracks 3.

A tension adjusting mechanism 8 mounted in the rear housing 2 for adjusting the tension of the belt-drive means is provided, and a pair of elongated handles 5 are pivotally mounted to the front housing 1 for providing support to the user. A computerized control console 6 is mounted to the front housing 1 for allowing the user to adjust the resistance provided by the load adjusting mechanism 9.

The load adjusting mechanism 9 comprises an L-shaped bracket 12 mounted to the side wall of a support member 11 of the front housing 1 and has a first opening 121 formed in its longest leg. There is further provided a support plate 13 having a ceiling member 132 with a second opening 131 that is in linear alignment with the opening 121 of the bracket 12. A pair of guide rollers 10 are mounted on the bracket 12 for guiding the belt 7, in combination with a cam member 95 rotatably mounted on the bracket 12. A ring member 94 is disposed about the cam member 95.

The cam member 95 includes a cylindrical body having a channel 951 passing therethrough and a pair of recesses 950 formed within an outer surface. A hollow pin member 92, and a cover 93 having a third opening 931 in linear alignment with the channel 951 of the cylindrical body forms portions of the cam member 95. The channel 951 and the opening 931 of the cover member 93 are in linear alignment with the opening 121 and 131 of the bracket 12 and the support plate 13. The ring member 94 is rotatably disposed about the cam member 95. The hollow pin member 92 comprises a tubular body having upper and lower ends 922 and 923, respectively, and a plurality of threaded recesses 921 are formed in the outer surface of the tubular body.

The hollow pin member 92 is adapted to extend through the opening 931 of the cover 93, the channel 951 of the cylindrical body of the cam member 95, and the opening 121 of the bracket 12 and to be secured therein by a pair of screws 952 which threadably engage the recesses 950 formed in the cylindrical body of the cam member 95 and the threaded recesses 921 of the pin member 92.

The assembled cam member is rotatably mounted on the bracket 12 by the pin member 92. Due to the fact that the opening 121 of the bracket 12 is located between the rollers 10, which guide the belt 7, the cam member 95 exerts a force on the belt 7 through the ring member 94.

An electric motor 91 is mounted to the support plate 13. The rotatable output shaft 911 of the motor 91 is securely received within the opening formed in the upper end 922 of the pin member 92. Actuation of the motor 91 rotates the cam member 95, thereby exerting a force on the belt 7 through the ring member 94.

For displaying the actual amount of the resistance of the load adjusting mechanism 9, a decoder member 96 is provided on the underside of the bracket 12. The decoder member 96 includes a substantially planar body having a circuit board 963 printed thereon, an opening 961 formed in the planar body, and a socket member 962 connected to the circuit board 963. The decoder member 96 is connected to the control console 6 through a conductor 61 connected to the socket member 962. A pick-up member 98 is rotatably and securely received in the opening of the lower end 923 of the pin member 92 by a pin 97. The pick-up member 98 includes prong members 982 formed from a resilient material composition. The pick-up member 98 and prong members 992 rotate with the cam member 96 to determine the actual position of the cam member 95 respective to the decoder member 96 for providing the actual amount of resistance provided by the load adjusting mechanism 9.

FIG. 3 shows a cross-sectional view of the load adjusting mechanism 9 and the inter-relationship of its components. The pin member 92 is securely fixed within the cam member 95. Actuation of the motor 91 rotates the output shaft 911, thereby rotating the pin member 92 and the pick-up member 98 and its prong members 982.

The ring member 94 prevents the build-up of friction between the cam member 95 and the belt 7 as the belt 7 rotates, thereby decreasing both the wear on the belt 7 and noise generated by the cam member 95.

As the prong members 982 rotate, the decoder member 96 outputs a feedback signal to the control console 6 to provide the user with information on whether the motor 91 should be stopped, rotated clockwise or counter-clockwise, thereby allowing the user to adjust and set the resistance of the load adjusting mechanism from the control console 6.

Figure 4:
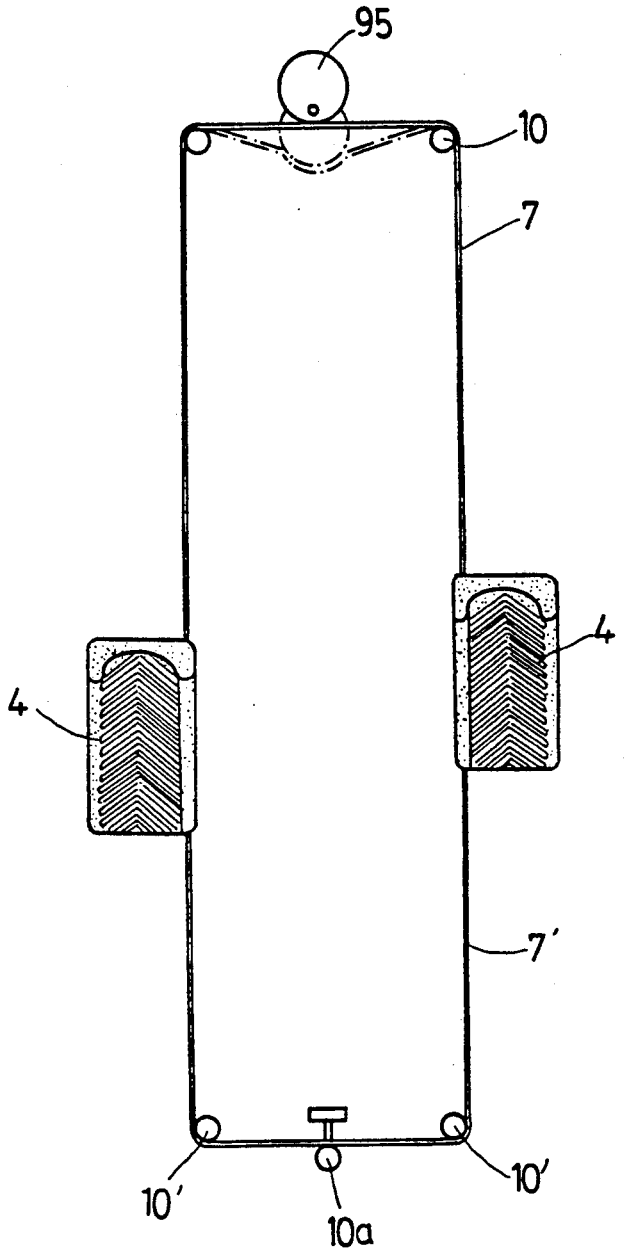
FIG. 4 is a top view showing a skiing simulator incorporated with a load adjusting mechanism in accordance with the present invention.
Figure 5:
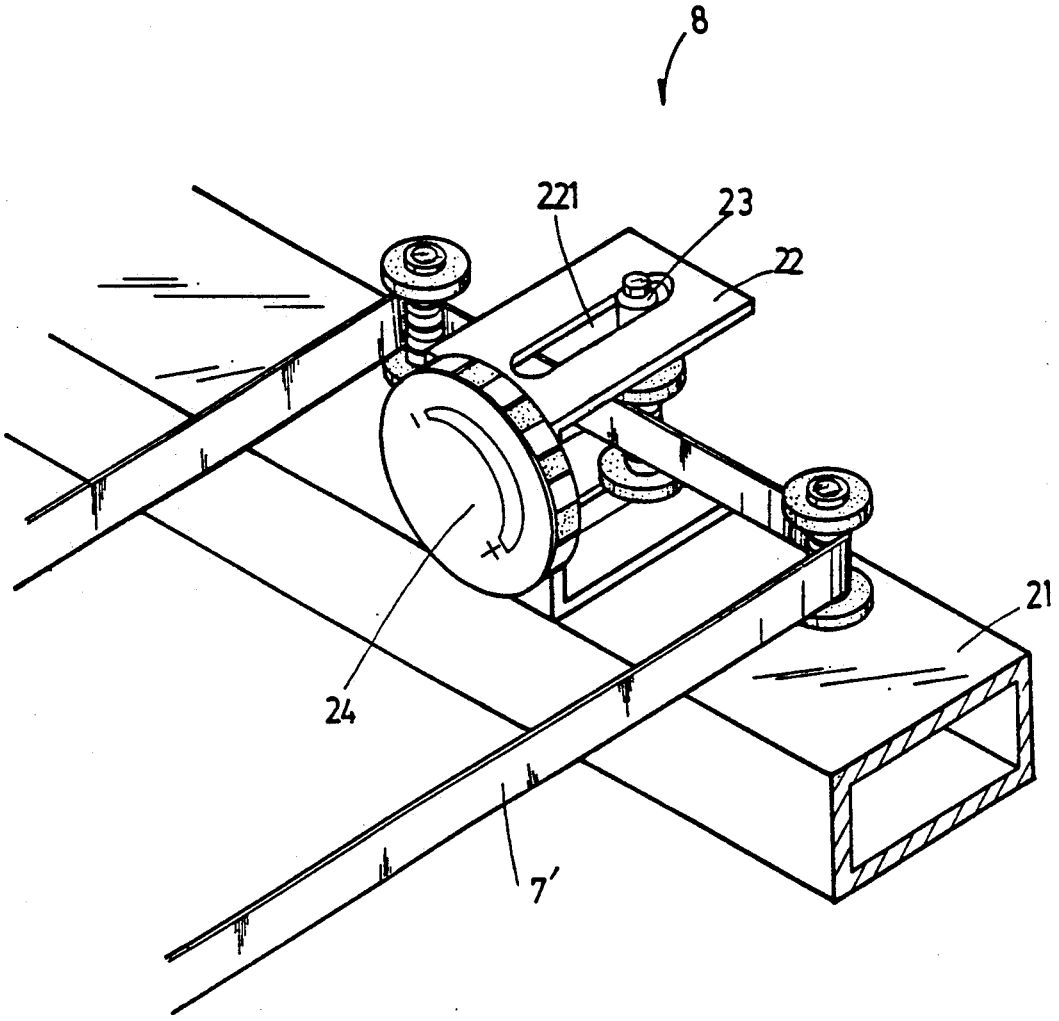
FIG. 5 is a perspective view showing a tension adjusting mechanism in accordance with the present invention.
Figure 6:
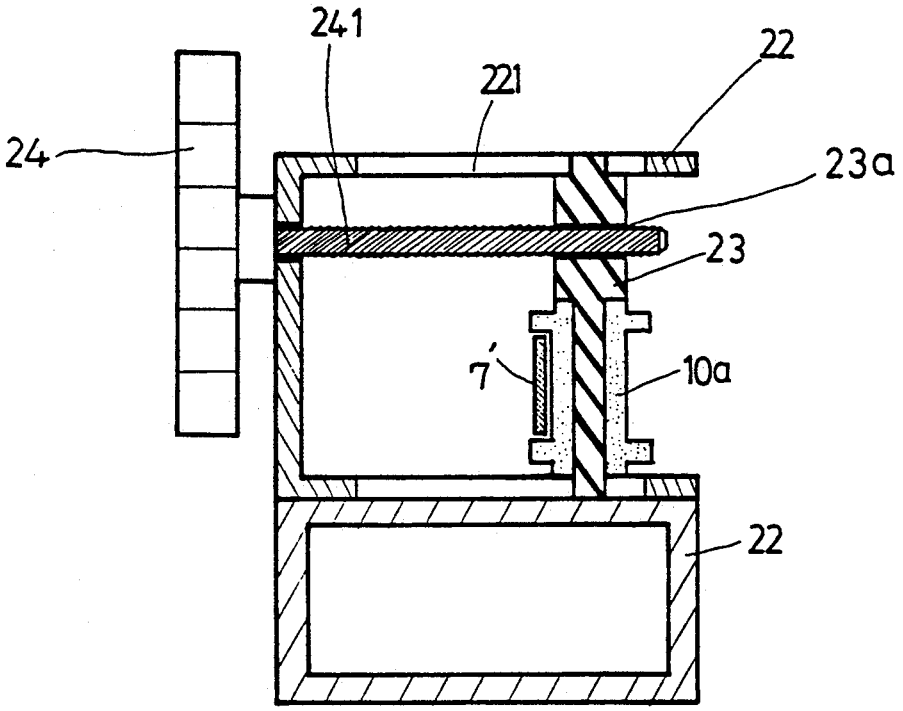
FIG. 6 is a cross-sectional view showing a tension adjusting mechanism shown in FIG. 5; and, FIG. 7 is a perspective view of a prior art skiing simulator.
Figure 7:
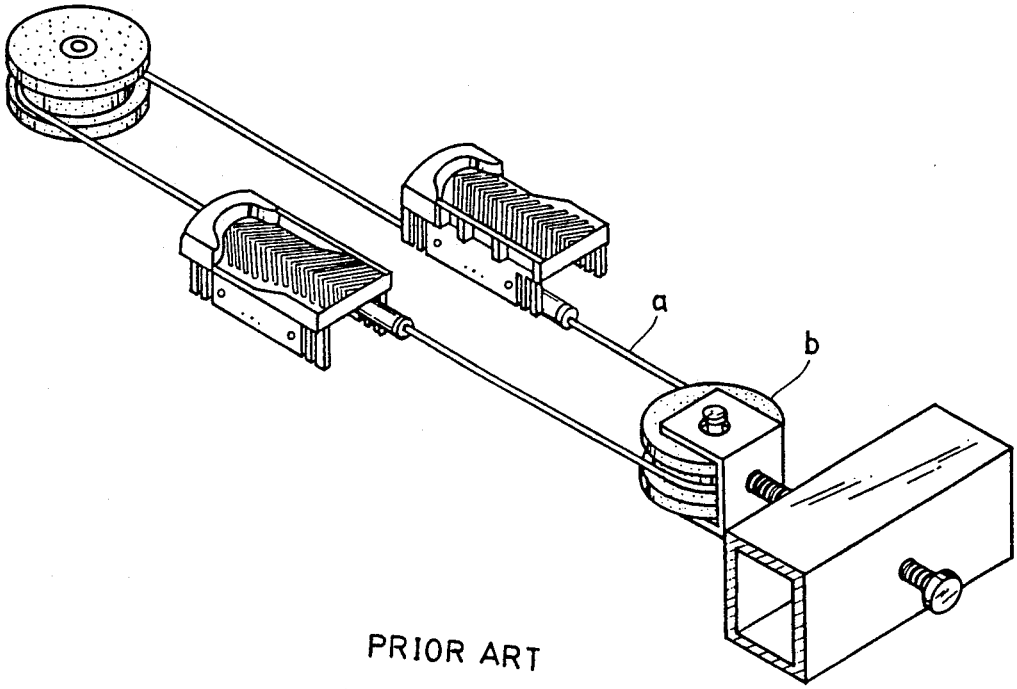
PRIOR ART FIG. 7

Referring now to FIGS. 4–6, in order to increase the effect of the load adjusting mechanism 9, the skiing simulator is provided with a tension adjusting mechanism 8 for adjusting and setting the correct tension of the belt 7'. If the belts 7 and 7' are too loose or too tight, the effect of the load adjusting mechanism 9 is diminished.

The tension adjusting mechanism 8 includes a support bracket 22 adjustably mounted on a support member 21 of the rear housing 2 by a guide slot 221 formed in the support bracket 22. A guide shaft 23 is slidably disposed in the guide slot 221, and a pair of guide rollers 10' are mounted on the support member 21. The guide shaft 23 is provided with a transverse opening 23a formed in its upper portion, and a guide roller 10a formed on its lower portion. The support bracket 22 includes a bolt 241 adapted to threadably engage the transverse opening 23a of the guide shaft 23. Rotation of the bolt 241 is controlled by a knob 24. By rotating knob 24, the distance between the guide shaft 23 and the knob 24 is adjustable, thereby increasing or decreasing the tension on the belt 7'.

The skiing simulator of the present invention has the following advantages: (1) the load adjusting mechanism 9 includes a cam member 95 for adjustably increasing or decreasing the resistance on the front-end belt 7 to provide a resistance selected by the user that is appropriate to his or her physical condition; (2) the control console 6 allows the user to adjust and to set the resistance of the load adjusting mechanism without stopping or interrupting a skiing exercise; (3) the ring member 94 prevents the build-up of friction between the front end belt 7 and the cam member 95, thereby decreasing the wear on the front end belt 7 and the noise generated by the cam member 95; and, (4) the tension adjusting mechanism 8 allows the user to adjust and select the tension of the rear-end belt 7', thereby allowing the user to compensate for any slack in the belt system.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A skiing simulator comprising:

(a) front and rear housings;

(b) a pair of parallel spaced apart guide tracks disposed between said front and rear housings;

(c) a pair of foot pedals slidably mounted on each of said guide tracks;

(d) belt means disposed about said guide tracks for moving each of said foot pedals in a reciprocating movement, said belt means having front and rear portions interconnected with front and rear ends of each of said foot pedals, respectively;

(e) tension adjusting means mounted on said rear housing for adjusting a tension load of said belt means;

(f) first guide means mounted on said rear housing for guiding said rear portion of said belt means;

(g) handle means pivotally mounted on said front housing for guiding and supporting a pair of arms of a user;

(h) load adjusting means mounted in said front housing for providing a resistive force to said belt means, said load adjusting means including a bracket mounted to a support member of said front housing, a support plate mounted to said bracket, a pair of linearly aligned first and second openings formed in said bracket and said support plate, respectively, a pair of guide rollers mounted on said bracket on opposite sides of said first opening for guiding said front portion of said belt means, a cam member rotatably mounted on said bracket by a hollow pin member which extends through said first opening in said bracket, a ring member rotatably disposed about said cam member, a motor mounted on said support plate and connected to said hollow pin member for rotating said cam member, a decoder member mounted to an underside of said bracket and connected to said hollow pin member for rotation with said cam member, a circuit board printed on said decoder member, a pick-up member connected to said hollow pin member for rotation with said cam member, and a pair of prong members extending from said pick-up member and contacting said circuit board on said decoder member for determining a position of said cam member with respect to said decoder member to provide a value of said resistive force exerted by said load adjusting means on said belt means; and, (i) a control console extending upwardly from said housing for adjusting said resistive force exerted by said load adjusting means on said belt means.

* * * * *